United States Patent [19]

Kossoff

[11] 4,253,601

[45] Mar. 3, 1981

[54] SELF CLOSING CARTON OR CONTAINER

[75] Inventor: Irwin I. Kossoff, Fort Lee, N.J.

[73] Assignee: United States Box Corp., Newark, N.J.

[21] Appl. No.: 55,346

[22] Filed: Jul. 6, 1979

[51] Int. Cl.[3] ..... B65D 5/00

[52] U.S. Cl. ..... 229/22

[58] Field of Search ..... 229/22

[56] References Cited

U.S. PATENT DOCUMENTS

| | | | |
|---|---|---|---|
| 1,897,143 | 2/1933 | Powell | 229/22 X |
| 3,178,092 | 4/1965 | Munana et al. | 229/22 |
| 3,482,760 | 12/1969 | Pascus et al. | 229/22 |
| 3,891,136 | 6/1975 | Woeste | 229/22 |

FOREIGN PATENT DOCUMENTS

| | | | |
|---|---|---|---|
| 703835 | 4/1966 | Italy | 229/22 |
| 6143 | of 1890 | United Kingdom | 229/22 |
| 277173 | 9/1927 | United Kingdom | 229/22 |

*Primary Examiner*—Davis T. Moorhead

*Attorney, Agent, or Firm*—Friedman, Goodman & Teitelbaum

[57] ABSTRACT

A self closing carton or container is formed from a blank of sheet material which folds together to form the elongated carton having a triangular cross section with self closing end flaps. The blank includes four adjacent rectangular side panels of substantially equal size, the outer two side panels being overlapped to thereby form the triangular cross sectional configuration of the carton. Triangular end flaps, with tab receiving slots, extend from the lateral ends of one rectangular side panel. At each lateral end of the next adjacent side panel is a pair of interconnected triangular end flaps, at the remote end of which is an outwardly extending tab. Each pair of end flaps can be folded over a respective first triangular end flap, whereby each tab locks into its corresponding slot. At each remote end of the last rectangular side panel is a triangular locking flap which can respectively securely fit between the first triangular flap and the outermost one of a pair of triangular flaps to be sandwiched therebetween to thus close and seal the carton.

14 Claims, 6 Drawing Figures

SELF CLOSING CARTON OR CONTAINER

BACKGROUND OF THE INVENTION

This invention relates to a carton and a blank for making the carton, and more specifically to a self closing carton of triangular cross sectional configuration.

Numerous types of cartons or containers of all sizes, shapes and configurations are readily available. However, as the configuration of the carton changes from a common rectangular box-like configuration, the blank becomes of more complex construction and requires more costly and time consuming manufacture, as well as presenting more difficulty in folding the blank to form the completed carton.

A further problem with many existing cartons, is that while they may be formed of a single blank, after folded into a completed shape, the carton must be sealed by means of various adhesives. The adhesives may be printed as part of the carton whereby portions of the carton must be heat sealed. In other situations, adhesives are added after the carton has been completed. Additionally, tapes may be needed to close off portions of the carton in order to seal it.

For elongated types of material, such as documents, manuscripts, rolls of postage stamps, etc., it has been found that the most convenient type of carton for transporting and shipping such documents is a tubular or cylindrical carton. The document can then be rolled and placed in the carton. The ends of the carton can typically be sealed off with plugs or other end closure device. Additionally, tapes can be pasted at the ends of the carton and the tapes folded inside the tubular cartons in order to seal off the ends. Such cartons are frequently used for mailing, and are frequently referred to as mailing tubes.

While such cylindrical or tubular cartons or containers are very useful for various types of documents and other material which cannot be folded, the cylindrical containers themselves are extremely awkward to use, store and ship. Although they provide good protection for their contents by avoiding the necessity of folding, the storage and transport of the containers themselves present a problem. Tubular or cylindrical containers must be shipped in their final condition. Thus, a manufacturer of the tubular containers must actually ship them as tubes. This takes up a considerable amount of shipping space. Also, the user must store the containers in its tubular shape, whereby an excessive amount of storage space is also required. An additional problem concerns the closure of the tubular containers. Generally the tubular containers are not self closing and require the addition of closure material. Such closure material must be pasted on at the time of manufacture or must be provided separately as insertable plugs or covers. Accordingly, an excessive amount of time and expense is required for storing, shipping and utilizing of such tubular containers.

SUMMARY OF THE INVENTION

It is accordingly an object of the present invention to provide a carton or container which can be used in place of conventional tubular or cylindrical containers, and which avoids the aforementioned problems of such cartons or containers.

A further object of the present invention is to provide a container which can be used as a replacement for tubular containers, and which can be shipped and stored as flat blanks.

Yet a further object of the present invention is to provide a self closing carton formed from a blank of sheet material.

A further object of the present invention is to provide an elongated carton of triangular cross sectional configuration which is self closing and can be formed of a blank of sheet material.

Still a further object of the present invention is to provide a blank for a carton, which can be folded to thereby provide an elongated carton of triangular cross sectional configuration with integral self closing and locking means.

Another object of the present invention is to provide a self closing carton which includes elongated side panels forming a triangular cross sectional configuration, and end panels which are self locking.

A further object of the present invention is to provide a carton which includes self locking end panels including one panel having an inwardly extending portion with a U-shaped slot therebetween to provide a locking seat for a U-shaped tab on a corresponding flap.

Still a further object of the present invention is to provide a self closing elongated carton of triangular cross sectional configuration having a perforated edge between two adjacent side panels.

Yet a further object of the present invention is to provide an elongated self closing carton having a cross sectional triangular configuration which is easy to manufacture, simple to put together, and can be stored and shipped in a flat condition until assembled.

Briefly, in accordance with the present invention there is provided a self closing carton or container formed from a blank of sheet material. The carton includes four substantially rectangular panels of equal size, with two of the panels overlapped to thereby form an elongated container of triangular cross sectional configuration. A first triangular end flap is located at each lateral end of the container for laterally closing the ends of the container. Each of these first end flaps supports a tab receiving slot along a side edge of the flap. A pair of interconnected triangular end flaps are also located at each lateral end. The pair of triangular end flaps fold over and sandwich therebetween the first end flap. A tab extends from a remote side edge of each pair of end flaps and the tab locks into its corresponding slot at that lateral end. A triangular locking flap at each lateral end of the container is sandwiched between the first end flap and the outermost one of the pair of the end flaps at each lateral end, to thereby retain the container in a closed and sealed condition.

Being formed from a blank of sheet material, all of the rectangular panels and triangular end flaps are integrally connected. The container can be stored and shipped in the flat condition until assembled.

A feature of the invention is that an additional section is inwardly extending from the side edge of each of the first end flaps. The slot is formed between the additional section and the adjacent end flap whereby the slot effectively provides a seat for receiving and retaining the adjacent tab.

A further feature of the invention is that a perforated edge if formed between two of the adjacent side panels whereby the carton can be easily opened by ripping the perforation.

The present invention also provides for a blank for making a self sealing carton or container. The blank is formed from a sheet of substantially stiff material having first and second opposing transverse marginal edges. Three transverse fold lines are longitudinally spaced between the marginal edges for sequentially defining four substantially rectangular side panels between said first and second marginal edges. A first pair of substantially triangular end flaps laterally extend from a first side panel. A longitudinal fold line respectively separates each end flap of this first pair from the adjacent first side panel. A substantially trapezoidal section respectively extends from the side edges of each of the end flaps of this first pair and specifically from the side edges remote from the first marginal edge. A respective U-shaped cut projects across from each of the remote side edges onto the base of the adjacent trapezoidal section. A diagonal fold line separates the rest of each trapezoidal section from its adjacent end flap.

A second pair of triangular end flaps laterally extend from the second side panels. A longitudinal fold line respectively separates each end flap of this second pair from the second side panel. A third pair of triangular end flaps respectively extend from the side edge of a respectively corresponding end flap of the second pair, and specifically from the side edge remote from the first marginal edge. A diagonal fold line respectively separates each end flap of the third pair from its adjacent end flap of the second pair. A U-shaped tab projects from the side edge of each end flap of this third pair. The U-shaped cut is of a size to securely receive the U-shaped tab.

A fourth pair of triangular end flaps laterally extend from the fourth side panel. A longitudinal fold line respectively separates each end flap of this fourth pair from the fourth side panel.

In an embodiment of the invention, each of the triangular end panels is of approximately equal size and each of the side panels is of approximately equal size. The fold line between the third and fourth panels can be perforated to permit easy opening of the carton after it is folded together.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENTS

Figure 1:
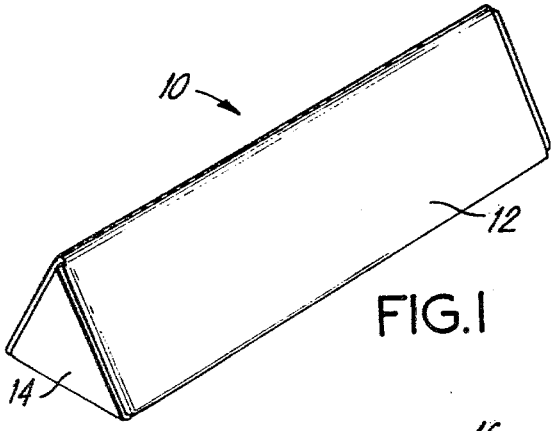
FIG. 1 is a perspective view of the carton or container of the present invention shown in a folded condition.

Referring now to FIG. 1, the carton or container of the present invention is shown generally at 10 and includes side panels 12 and end flaps 14. The side panels are of rectangular configuration thereby providing an elongated container, and the end flaps are of a triangular configuration whereby the cross sectional area of the elongated container is that of a triangle. Because of the triangular configuration, the present invention can easily accommodate items usually placed within a tubular container. For example, rolled up documents, rolls of postage stamps, etc., normally placed in a tubular or cylindrical container, can now be placed within the present triangular carton. However, as will become evident from the following discussion, although a tubular or cylindrical container must be stored and shipped in its tubular condition, the present container can be shipped, stored and maintained in its flat condition as a blank, and only folded together prior to actual use. Furthermore, because of the triangular configuration it is easy to stack a group of assembled triangular cartons. Each of the sides 12 can be stacked onto a corresponding side of the next adjacent carton whereby there is no loss of storage space between the cartons. On the other hand, with tubular containers, when they are stored, there is space wasted between the containers since the tubular containers will only have tangential contact with each other rather than planar contact, as in the case of the present invention.

The carton of the present invention is formed from a blank of sheet material which will be described in connection with FIG. 2. The blank of material, shown generally at 16, is formed of material useful for making a container, such as cardboard or the like. The blank includes a first transverse marginal edge 18 and an opposing transverse marginal edge 20. Longitudinally spaced between the marginal edges are the three parallel transverse fold lines 22, 24, 26. The fold lines 24 and 26 are scored while the fold line 22 is preferably perforated. The three transverse fold lines 22, 24, 26 separate the space between the marginal edges 18, 20 into four substantially rectangular side panels identified as 28, 30, 32 and 34. The side panels are of approximate equal area although some slight adjustments are made at their respective lateral edges, as will become apparent from the following description.

At the lateral edges of the side panel 28 are formed triangular end flaps 36, 38. The end flaps are each isosceles triangles with all the edges being equal. Interconnecting the end flap 36 with the side panel 28 is a scored longitudinal fold line 40, and a corresponding scored longitudinal fold line 42 interconnects the side panel 28 with the other laterally extending end flap 38.

Upwardly extending from the upper edge of each of the end flaps 36, 38 is a trapezoidal extension 44, 46. A U-shaped cut out shown generally at 48 is formed between the trapezoidal sections 44 and the adjacent end flap 36. A corresponding U-shaped cut out 50 is formed on the other side between the end flap 38 and its adjacent trapezoidal section 46. The U-shaped cut out 48 is formed with the short cuts 52, 54 laterally extending across the side edge of the end flaps 36 and into the trapezoidal section 44. These short cuts are interconnected by means of the connecting cut 56 extending across the trapezoidal section and parallel with its base. A scored diagonal fold line 58 extends between the trapezoidal section 44 and its adjacent end flap 36 in the area not included within the U-shaped cut out section 48. A corresponding scored diagonal fold line 60 is present on the other side between flap 38 and section 46. It will be appreciated that the cuts 52, 54 are transverse to the fold line 58 and the connecting cut 56 is parallel but spaced from the fold line 58. The U-shaped cut out 50 on the other lateral end of the container is formed similar to that described for the U-shaped cut out 48 and will therefore not be described in detail.

Laterally extending on either end of the side panel 30 are additional triangular end flaps 62, 64. These triangular flaps are also isosceles in shape and substantially equal to the triangular flaps 36, 38. It will be noted that the side edge 66 of the end flap 62 is commensurate with the side edge 68 of the trapezoidal section 44 and the line therebetween is cut. A similar situation exists at the opposite end of the container between the flap 64 and the trapezoidal section 46.

A further flap of triangular configuration 70 is connected at the remote edge of the triangular end flap 62, whereby the two triangles 62, 70 form a rhombus with their adjacent sides forming the diagonal of the rhombus. A similar triangular end flap 72 is formed adjacent to the end flap 64. At the upper edge of the triangular end flap 70 is formed a U-shaped tab 74 with a corresponding tab 76 formed on the opposite triangular flap 72. The U-shaped tabs 74, 76 are formed to be received within the U-shaped slots 48, 50 previously described.

A scored longitudinal fold line 78 interconnects the end flap 62 with the side panel 30, and a corresponding scored longitudinal fold line 80 interconnects the end flap 64 with the side panel 30. A pair of spaced apart and parallel scored diagonal fold lines 82, 84 are formed between the adjacent end flaps 62 and 70. A corresponding pair of scored diagonal fold lines 86, 88 are formed between the flaps 64 and 72 at the opposite side. The spacing between the diagonal fold lines 82, 84, as well as between the fold lines 86, 88, is approximately equal to twice the thickness of the sheet material which forms the blank.

The lateral ends of the side panel 32 form marginal side edges 90, 92 and are longitudinal continuations of the fold lines 78 and 80 respectively.

At the lateral ends of the side panel 34 are formed additional triangular end flaps 94 and 96. A scored longitudinal fold line 98 separates the end flap 94 from the panel 34 and a corresponding scored longitudinal fold line 100 separates the end flap 96 from the panel 34. The remote vertex of the triangle 94 is rounded off at 102, and corresponding rounding off 104 is formed at the outer vertex of the end flap 96. It should be appreciated that these triangular end flaps 94, 96 are also isosceles, with the exception of the rounded vertexes, and are of again approximately the same size as all the other triangular end flaps.

Although the side edge 90 is a longitudinal extension of the fold line 78, the fold line 40 adjacent the side panel 28 is inwardly displaced a distance 106 which approximates the distance of twice the thickness of the sheet material from which the blank is constructed. A corresponding inward displacement of fold line 42 exists at the opposite end of the side panel 28. With regard to the uppermost panel 34, the fold line 100 is inwardly displaced by a distance 108. This latter distance corresponds to a single thickness of the material from which the blank is constructed. It is understood that the fold line 98 is similarly inwardly displaced.

Figure 2:
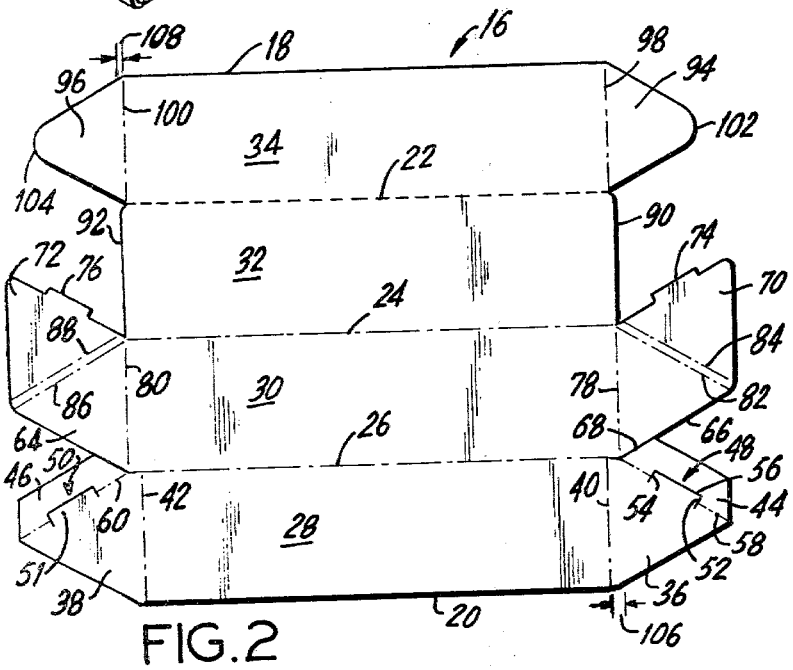
FIG. 2 is a plan view of the blank of sheet material which is utilized to form the carton of the present invention.

The self closing carton of the present invention is folded from the blank shown in FIG. 2 as can best be understood with regard to FIGS. 3–6. The end panels 36, 38 are first folded inwardly, the trapezoidal extensions 44 and 46 are folded downwardly, and the lowest panel 28 is folded upwardly so that the trapezoidal extensions 44, 46 lie against the inside of the panel 30. The pair of flaps 62, 70 are then folded around the end flap 36 whereby the flap 70 will be positioned on the inside of the container, while the end flap 62 will remain outside of the container with respect to flap 36. Flap 36 will then be sandwiched between the two flaps 62, 70. The flap 70 is held in place by means of the tab 74 engaging into the cut out 48.

Figure 4:
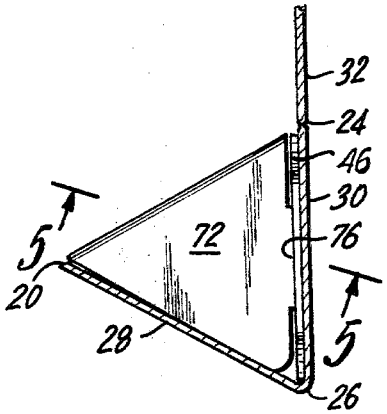
FIG. 4 is a side sectional view taken along lines 4—4 of FIG. 3 and showing the interlocked end flaps.
Figure 5:
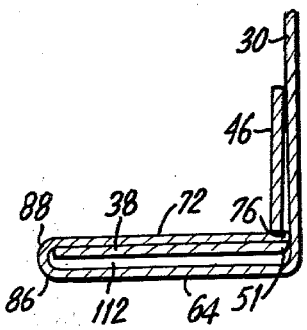
FIG. 5 is a partial sectional view taken along line 5—5 of FIG. 4 and specifically taken through an interlocked tab and slot.
Figure 3:
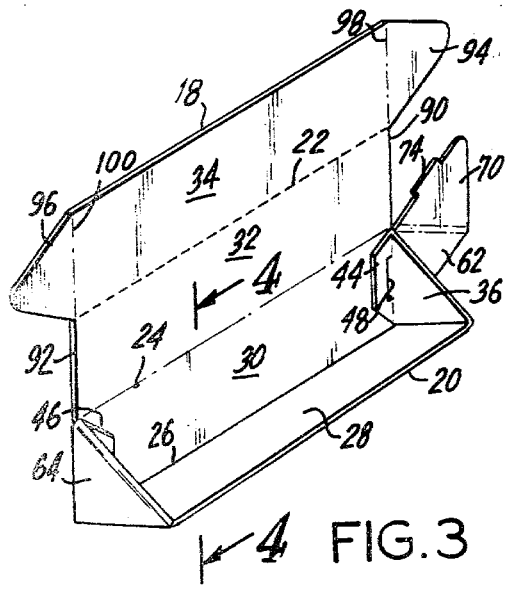
FIG. 3 is a perspective view showing a part of the assembly of the carton and specifically showing the folding over of the end flaps.

FIG. 3 shows the left end already folded as stated above with the tab 76 positioned within the corresponding cut out 50. FIGS. 4 and 5 show more details of this locking arrangement. Specifically, it will be noted that the connecting cut of the U-shaped cut out 50 is in the trapezoidal section. As a result, since it is spaced from the fold line 60 and the trapezoid 46 will bend on the fold line 60, a tab 51 is formed. The tab 51 abuts the back wall 30 so that the slot formed thereby will be spaced from the back wall 30. At the same time, when the trapezoidal section 46 is folded, there will be an enlarged space between the end flap 38 having the tab 51 thereon and the portion on the trapezoid from which the tab 51 is cut. This space is best seen in FIG. 5 and it is in this enlarged space that the tab 76 fits. As a result, the U-shaped cut out 50 effectively forms a seating slot which is spaced from the panel 30, being formed in the trapezoid extension 46, which can then receive and seat the U-shaped extending tab 76. The U-shaped tab 76 is disposed against the tab 51 and will therefore actually be locked into the slot which receives it. This will serve to securely hold the folded over member 72 in place and, with both ends folded over, the lower portion 28, as shown in FIG. 3, will be securely held in place with respect to the side panel 30.

As can best be seen in FIG. 5, the folded over portions 64, 72 are spaced apart a distance of the double thickness of the sheet material. One thickness is accommodated by the side flap 38 which is sandwiched therein. However, there is still room for another thickness. It is this space which serves as a slot receiving member into which the locking end panels 94, 96 are respectively inserted.

Figure 6:
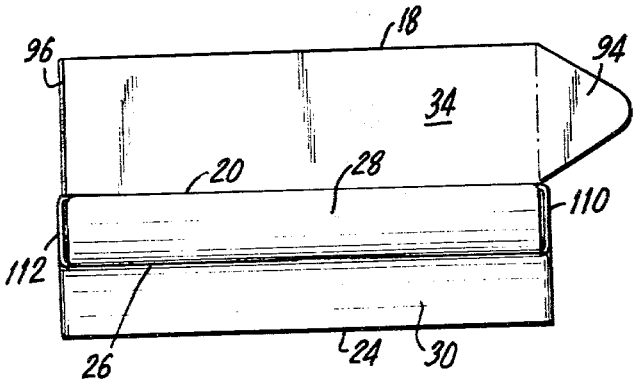
FIG. 6 shows a final closing of the entire carton and specifically the folding of the locking flaps.

As indicated in FIG. 6, first the panel 32 is folded over along line 24 and then along line 22 so that the panel 34 is now adjacent to the opposite panel 28. The end locking flaps 94, 96 of panel 34 are folded along the fold lines 98 and 100. The locking flap 94 can then be inserted into the space 110 as shown in FIG. 6 and the other locking tab 96 can similarly be inserted into the space 112 provided. The space 112 is also shown in FIG. 5. Once the locking tabs have been inserted into the spaces provided for them, the entire carton is self closed and will be held closed, as shown in FIG. 1. It will be appreciated that no adhesives are needed and no further tapes need be provided in order to keep the carton closed.

It will also be appreciated that the spacing between the diagonals 82, 84 as well as 86, 88 are spaced apart at a double thickness and they each enclose two end flaps, specifically the end flaps 36, 38 as well as the respective locking flaps 94, 96 are retained in their corresponding spacing. In a similar manner, since the end locking flaps 94, 96 are placed inwardly of the outer flaps 62, 64, and in order to retain the outer surface in a flush manner, these flaps 94, 96 are spaced inwardly only a single thickness.

The flaps 36, 38 are likewise moved inwardly a double thickness to permit accommodation of two flaps outwardly therefrom, specifically the flaps 94, 96 respectively, and the flaps 70, 72 respectively.

The edges 102, 104 are rounded off in order to faciliate insertion of the locking flaps 94, 96 into the spaces 110, 112 provided for them between the other flaps.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A blank for a carton, comprising:

a sheet material, said sheet having first and second opposing transverse marginal edges, three transverse fold lines longitudinally spaced between the marginal edges for sequentially defining four substantially rectangular side panels between said first and said second marginal edges;

a first pair of substantially triangular end flaps laterally extending from opposite ends of a first side panel, a longitudinal fold line respectively separating each end flap of said first pair from said first side panel;

a substantially trapezoidal section respectively extending from a side edge of each end flap of said first pair which side edge is remote from said first marginal edge, a respective U-shaped cut projecting across from each of said remote side edges onto a base of its adjacent trapezoidal section, a diagonal fold line separating remaining portion of each said trapezoidal section from its adjacent end flap;

a second pair of triangular end flaps laterally extending from a second side panel, a longitudinal fold line respectively separating each end flap of said second pair from said second side panel;

a third pair of triangular end flaps, each end flap of said third pair respectively extending from a side edge of an end flap of said second pair which lies remote from said first marginal edge, a diagonal fold line respectively separating each end flap of said third pair from its adjacent end flap of said second pair, a U-shaped tab projecting from a side edge of each end flap of said third pair which side edge lies remote from said first marginal edge, said U-shaped cut being of a size to securely receive said U-shaped tab;

a fourth pair of triangular end flaps laterally extending from a fourth side panel, a longitudinal fold line respectively separating each end flap of said fourth pair from said fourth side panel; and said first and second side panels being adjacent to each other, said second and third side panels being adjacent to each other, and said third and fourth side panels being adjacent to each other to define said four side panels.

2. A blank for a carton as in claim 1, wherein each of said triangular end flaps is of approximately equal size, and each of said side panels is of approximately equal size.

3. A blank for a carton as in claim 1, wherein an additional diagonal fold line is provided between the end flaps of said third pair and the end flaps of said second pair, to thereby form a pair of parallel spaced apart diagonal fold lines therebetween, whereby said end flaps of said third pair can be folded over the end flaps of said second pair to define a slot therebetween.

4. A blank for a carton as in claim 3, wherein the spacing between said parallel spaced apart diagonal fold lines is approximately twice the thickness of said sheet material to thereby respectively accommodate within said slot an end flap of said first and fourth pairs.

5. A blank for a carton as in claim 1, wherein the respective longitudinal fold line separating each flap of said first pair from the first side panel is respectively inwardly displaced from the longitudinal fold lines separating each end flap of said second pair from said second side panel.

6. A blank for a carton as in claim 5, wherein said inward displacement is approximately twice the thickness of said sheet material.

7. A blank for a carton as in claim 1, wherein the longitudinal fold line respectively separating each end flap of said fourth pair from said fourth side panel is respectively inwardly displaced from the longitudinal fold lines separating each end flap of said second pair from said second side panel.

8. A blank for a carton as in claim 7, wherein said inward displacement is approximately equal to the thickness of said sheet material.

9. A blank for a carton as in claim 1, wherein the respective lateral ends of the third side panel form side marginal edges and respectively extend longitudinally from the longitudinal fold lines respectively separating each end flap of said second pair from said second side panel.

10. A blank for a carton as in claim 1, wherein the lateral vertex of the end flaps of said fourth pair are rounded.

11. A blank for a carton as in claim 1, wherein the transverse fold line between the third and fourth side panels is perforated.

12. A blank for a carton as in claim 1, wherein said U-shaped cut has side cut lines transverse to the diagonal fold lines separating the trapezoidal section from the respective adjacent end flap and extends into the trapezoidal section, and a connecting cut line formed on the trapezoidal section is parallel to and spaced from said last mentioned diagonal fold line.

13. A self closing carton formed of a blank of sheet material, comprising:

first, second, third and fourth rectangular panels connected together, said first and fourth panels being overlapped to thereby provide an elongated container of triangular cross sectional configuration;

a first triangular end flap at each end of said first panel for laterally closing opposite ends of the container, each of said first end flaps supporting a tab receiving slot along a side edge thereof;

a pair of interconnected triangular end flaps at each end of said second panel, said pair of end flaps being folded over and sandwiching therebetween a respective said first end flap, a tab extending from a remote side edge of each said pair of end flaps and locking into a respective said slot;

a triangular locking flap at each end of said fourth panel sandwiched between a respective said first end flap and a respective outermost one of said pair of end flaps; and an additional section inwardly extending from said side edge of each of the first end flaps, each said slot being disposed between one of said first end flaps and said additional section associated therewith to provide a spaced apart seat for receiving and retaining an associated said tab.

14. A self closing carton formed of a blank of sheet material, comprising:

first, second, third and fourth rectangular panels connected together, said first and fourth panels being overlapped to thereby provide an elongated container of triangular cross sectional configuration;

a first triangular end flap at each end of said first panel for laterally closing opposite ends of the container, each of said first end flaps supporting a tab receiving slot along a side edge thereof;

a pair of interconnected triangular end flaps at each end of said second panel, said pair of end flaps being folded over and sandwiching therebetween a respective said first end flap, a tab extending from a remote side edge of each said pair of end flaps and locking into a respective said slot;

a triangular locking flap at each end of said fourth panel sandwiched between a respective said first end flap and a respective outermost one of said pair of end flaps; and a perforation fold line being provided between said third and fourth side panels.

* * * * *